US009500431B2

(12) United States Patent
Lyman

(10) Patent No.: US 9,500,431 B2
(45) Date of Patent: Nov. 22, 2016

(54) DUMMY CYLINDER FOR A REVOLVER

(71) Applicant: Robert Neale Lyman, Centennial, CO (US)

(72) Inventor: Robert Neale Lyman, Centennial, CO (US)

( * ) Notice: Subject to any disclaimer, the term of this patent is extended or adjusted under 35 U.S.C. 154(b) by 0 days.

(21) Appl. No.: 14/816,797

(22) Filed: Aug. 3, 2015

(65) Prior Publication Data

US 2016/0084604 A1 Mar. 24, 2016

Related U.S. Application Data

(60) Provisional application No. 62/031,994, filed on Aug. 1, 2014.

(51) Int. Cl.

| | |
|---|---|
| ***F41C 3/14*** | (2006.01) |
| ***F41A 33/00*** | (2006.01) |
| ***F41A 15/02*** | (2006.01) |
| ***F41A 9/28*** | (2006.01) |

(52) U.S. Cl.

CPC ..... *F41A 33/00* (2013.01); *F41A 9/28* (2013.01); *F41A 15/02* (2013.01)

(58) Field of Classification Search

CPC ..... F41A 33/00; F41A 33/02; F41A 17/44; F41C 3/14; F41C 3/04

USPC ..... 42/59, 70.11, 66, 89; 102/444

See application file for complete search history.

(56) References Cited

U.S. PATENT DOCUMENTS

| | | | | | |
|---|---|---|---|---|---|
| 2,377,703 | A * | 6/1945 | Loomis | F41A 3/32 | 42/22 |
| 2,497,085 | A * | 2/1950 | Jeffers | F41A 33/00 | 434/24 |
| 3,022,598 | A * | 2/1962 | Wikstrom | F41A 17/44 | 102/430 |
| 3,049,828 | A * | 8/1962 | Mills | F41C 3/00 | 102/441 |
| 3,208,176 | A * | 9/1965 | Giles | F41A 17/44 | 42/66 |
| 3,217,441 | A * | 11/1965 | Kerr | F41C 7/12 | 102/444 |
| 3,624,946 | A * | 12/1971 | Cagnoni | F41C 3/04 | 42/54 |
| 3,757,448 | A * | 9/1973 | Petrucci | F41C 3/14 | 42/59 |
| 3,765,116 | A | 10/1973 | Zaid | | |
| 3,955,301 | A * | 5/1976 | Wiethoff | F41A 9/85 | 42/59 |
| 3,999,320 | A * | 12/1976 | Zaubzer | F41C 3/04 | 42/1.08 |
| 4,316,339 | A * | 2/1982 | Herriott | F41A 21/488 | 42/59 |
| 4,357,774 | A * | 11/1982 | Badger | F41A 21/06 | 42/59 |
| 4,367,516 | A * | 1/1983 | Jacob | F41G 3/2655 | 362/111 |
| 4,483,088 | A * | 11/1984 | Tussing | F41A 17/00 | 42/1.05 |
| 4,558,530 | A * | 12/1985 | de Witt | F41C 3/14 | 42/59 |
| 4,771,561 | A * | 9/1988 | Waiser | F41C 3/14 | 42/59 |
| 5,004,423 | A | 4/1991 | Bertrams | | |
| 5,220,115 | A * | 6/1993 | Wales | F41C 3/14 | 42/59 |
| 5,239,767 | A * | 8/1993 | Briley, Jr. | F41A 17/44 | 42/70.11 |
| 5,488,794 | A * | 2/1996 | Arrequin | F41A 17/44 | 42/66 |
| 5,782,029 | A * | 7/1998 | Brooks | F41A 17/02 | 42/70.11 |
| 6,041,536 | A * | 3/2000 | Samuels | F41A 17/44 | 42/70.11 |
| 6,047,490 | A * | 4/2000 | Kirst | F41C 9/08 | 42/59 |
| 6,647,654 | B2 | 11/2003 | Iten | | |
| 2005/0016050 | A1* | 1/2005 | Howell, Jr. | F41C 9/08 | 42/61 |

* cited by examiner

*Primary Examiner* — Michael David

(57) ABSTRACT

A dummy cylinder for a revolver that permits dry fire practice but does not permit the insertion of live ammunition. The dummy cylinder approximately duplicates the outer dimensions of a normal cylinder so that it may replace the normal cylinder for safer training. It may use the extractor and ratchet of the revolver or may be constructed to simulate the dimensions of those parts. It may contain integral firing-pin cushioning devices, or may be constructed to allow the insertion of such devices while preventing the insertion of live ammunition.

20 Claims, 4 Drawing Sheets

DUMMY CYLINDER FOR A REVOLVER

BACKGROUND

It is well known in the art of firearms marksmanship to practice by "dry firing." This is the actuation of the trigger and firing mechanism without the use of live ammunition. When performed with due care, it is a safe means to gain familiarity and "muscle memory" that improves accuracy at low cost. Products known as "snap caps" are sometimes used to simulate the presence of ammunition and thus avoid any damage to the firearm that might occur. These devices have the approximate external shape of live ammunition and thus may be inserted into the chamber before practicing, but inside contain a small plunger and a spring that absorb the shock of the firing pin as a primer might.

However, firearms users do not always exercise due care. Sometimes live ammunition is placed in the chamber rather than a snap cap. As a result, the firearm may be discharged unintentionally, posing a significant risk of injury or death. In addition, there is no easy way for someone to confirm visually that snap caps are inserted rather than live ammunition. Thus, for instance, while and instructor might wish to have students conduct dry fire drills in a classroom rather than on a firing range, doing so tends to encourage the violation of fundamental safety rules because it involves pulling the trigger of a firearm without a proper bullet-absorbing backstop.

Other forms of practice, such as drawing from a holster or drawing from concealment, are also potentially dangerous if attempted without proper attention to the unloading of the firearm.

Special devices which simulate both the external dimensions of firearms, which are useful for practicing drawing from a holster or conducting retention and takeaway drills with a partner, do exist. In addition, some manufacturers produce devices that simulate both the appearance and the operation of particular firearms, but which do not permit ammunition to be inserted, to allow the experience of dry firing in safety. However, the cost of such dummy guns is often prohibitive for the average person. In some cases the dimensional fidelity of dummy guns can be questionable, which can mean that, for instance, drawing a plastic casting of a gun from a holster can be a very different experience than drawing the real thing, and therefore encourage the development of bad habits. Thus such tools are often limited to law enforcement or military agencies with sufficiently large budgets and competent armory staffs to ensure proper operation and training value.

SUMMARY

A replacement cylinder for a revolver which is incapable of receiving live cartridges and which may optionally integrate a mechanism for cushioning the firing pin of the revolver.

DRAWINGS

DETAILED DESCRIPTION

For the purposes of this application, the term "firing cylinder" shall be used to refer to that part of a functioning revolver that contains chambers intended to receive ammunition for the purpose of firing. This term is used to differentiate the cylinder, as it is usually known in the art, from the "dummy cylinder" that is the subject of this application.

Figure 1:
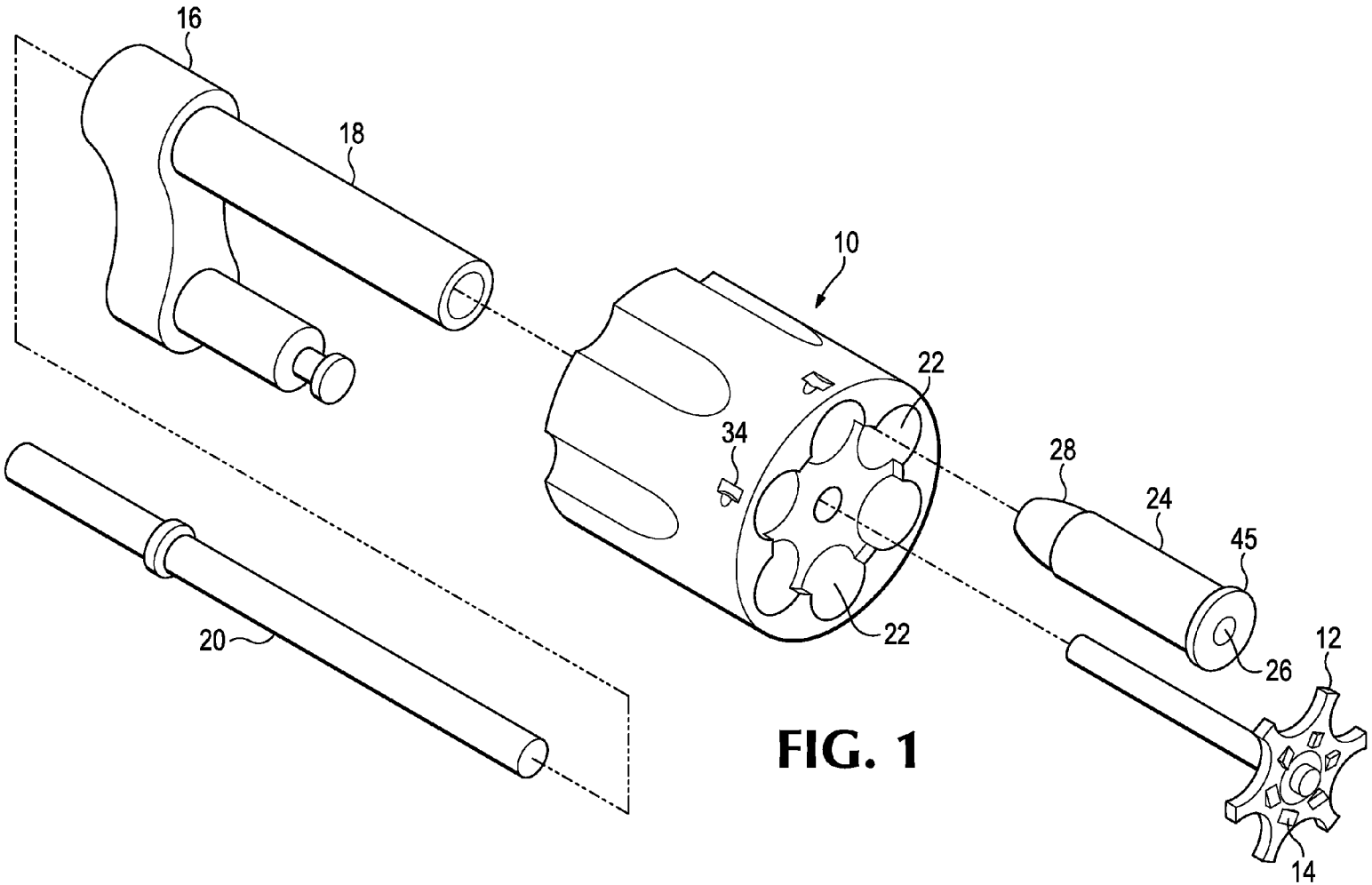
FIG. 1 is an exploded view of a revolver's cylinder showing the parts of a functional firearm and a live cartridge intended for use in that firearm.
Figure 2:
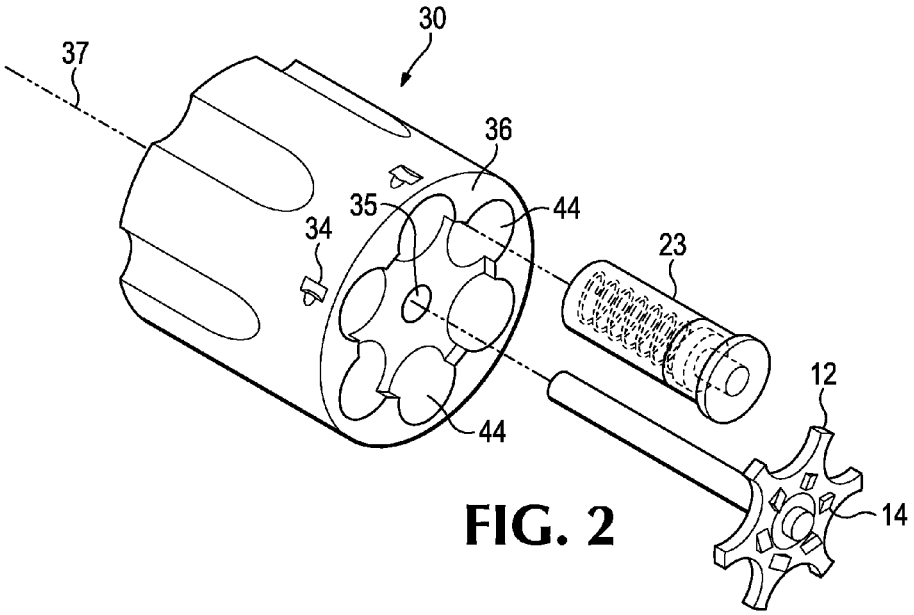
FIG. 2 is a perspective view of one embodiment of a dummy cylinder intended to permit safe practice and training, which receives the ratchet and extractor of the revolver into its back end, and with chambers sized to receive certain types of snap caps as shown, but not live cartridges.

FIG. 1 shows a exploded view of a firing cylinder 10, extractor 12, ratchet 14, crane 16 with pivot tube 18, and center rod 20 taken from an ordinary double-action revolver, as is well known in the art. The cylinder 10 has chambers 22 which receive cartridges 24 for firing. In use, the firing cylinder 10 rotates about pivot tube 18 when the hammer is cocked or the trigger is pulled in order to place a fresh cartridge in front of the firing pin. When struck by the firing pin, the primer 26 detonates, igniting the gunpowder and propelling the bullet 28 out of the firearm.

When a user wishes to practice pulling the trigger without actually firing a round, it is common to insert action proving dummies, or "snap caps" 23 into the chambers 22. These devices are intended to simulate the presence of the primer 26 to prevent possible damage to the firing pin. A snap cap 23 has external dimensions that simulate those of a live cartridge 24 to allow it to sit snugly in the chamber 22.

In order to prevent the accidental placement of live ammunition in the chamber 22 and the subsequent discharge of the firearm, it is desirable to replace cylinder 10 with non-firing dummy cylinder 30, as shown in FIGS. 2-4 and 6-7. Dummy cylinder 30 is designed to take the place of cylinder 10 in all respects. It has an external dimensions that closely match the relevant external dimensions of cylinder 10. For instance, diameter 33 must be close to those of cylinder 10, and the location of stop notches 34 must also match those of the original, and the placement of flutes may be necessary to facilitate installation. The length 32 may be similar to that of the firing cylinder 10, or may be substantially shorter, and thus the length 32 is not a "relevant" external dimension except to the extent that it must not be too long. The dummy cylinder 30 must have a hole 35 passing along axis 37 to accommodate pivot tube 18 and permit the dummy cylinder 30 to be mounted on the revolver. In one embodiment, best shown in FIG. 2, the dummy cylinder 30 is intended to be used in conjunction with the extractor 12 and ratchet 14, and thus must have the back end 36 configured to receive them. In another embodiment, best shown in FIG. 3, a close facsimile 38 of the extractor 12 and ratchet 14 are formed integrally onto the back end 36.

Figure 4:
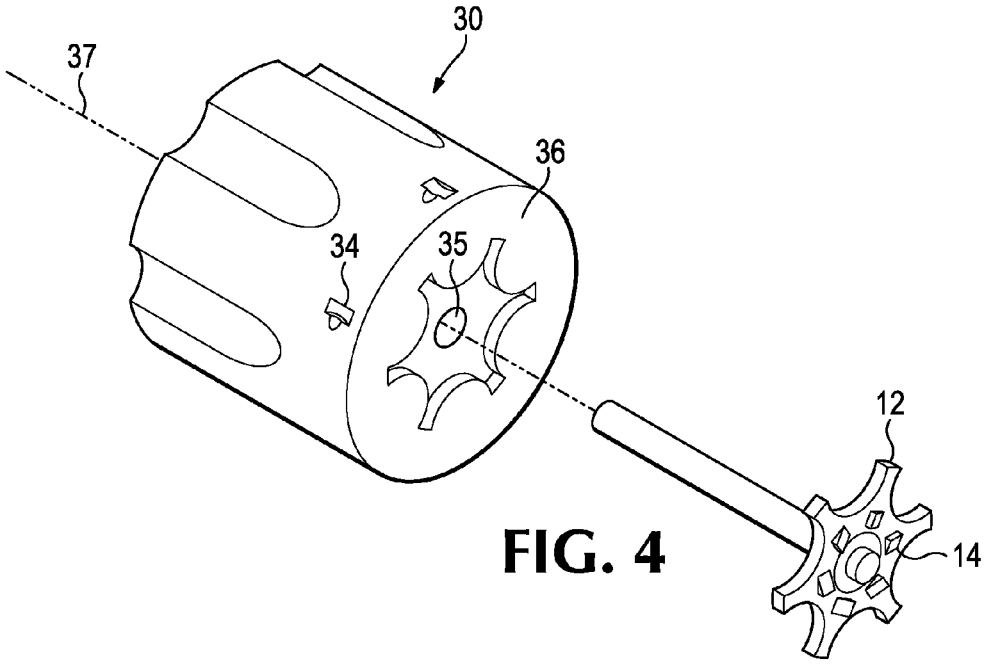
FIG. 4 is a perspective view of still another embodiment of a dummy cylinder which has a completely solid back end where chambers would normally be located.
Figure 5:
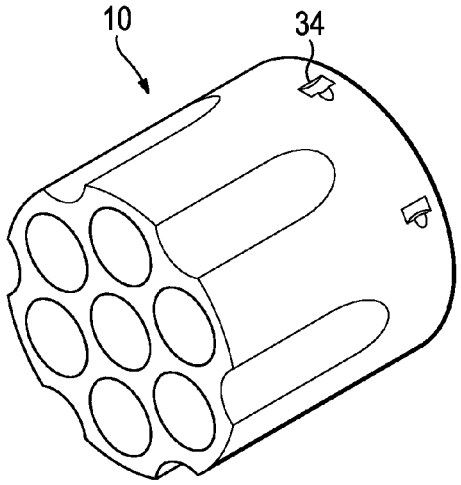
FIG. 5 is a perspective view showing the cylinder of a functional firearm, with openings on the front face to allow a bullet to be fired.
Figure 6:
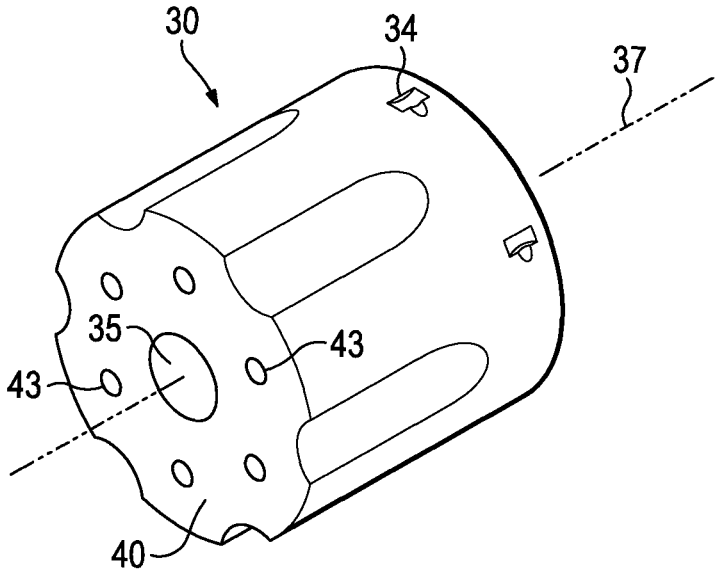
FIG. 6 is a perspective view of an embodiment of a dummy cylinder with small holes in the front face to facilitate accurate manufacturing.
Figure 7:
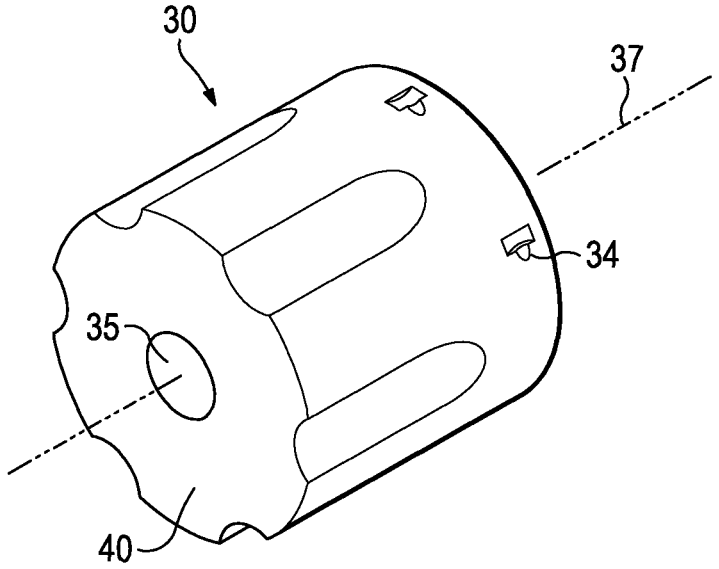
FIG. 7 is a perspective view of an embodiment of a dummy cylinder with a smooth front face.

The internal dimensions of the dummy cylinder 30 are very different from those of cylinder 10. For safety reasons, it is essential that it be impossible to insert cartridges 24 into dummy cylinder 30, and therefore the dummy cylinder 30 must not have chambers 22 large enough to receive live ammunition of the type intended for use in the revolver. It is possible to make dummy cylinder 30 completely solid, with a smooth front end 40 (as shown in FIG. 7) and with no openings 44 at all in back end 36 (as shown in FIG. 4). It is also possible to have a small holes 43 in the front end 40, as may be necessary to facilitate removal of a plastic part from a mold used in its formation. In alternative embodiment, best shown in FIG. 2, the chambers 22 are replaced with smaller openings 44 meant to receive snap caps 23. Certain brands of snap caps 23 are made with dimensions smaller than those of live cartridges, and therefore an opening 44 can be devised that receives snap caps 23 but not live cartridges 24. This is not, however, the most preferred way to make the cylinder, because it may still be possible to insert cartridges 24 of a smaller caliber than intended for the revolver into these openings 44, which could pose a risk of explosion.

Figure 3:
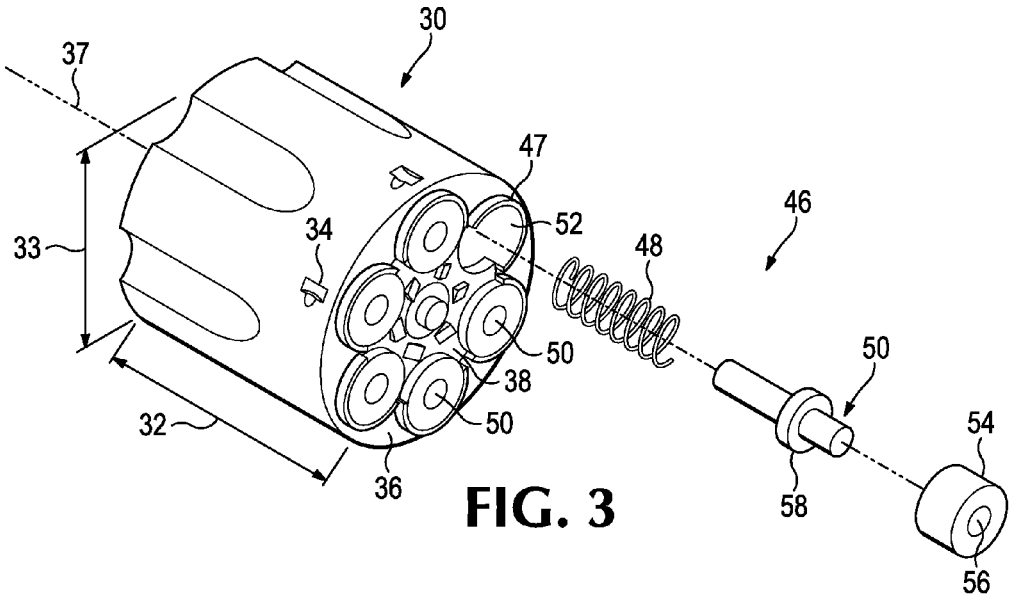
FIG. 3 is a perspective view of an alternative embodiment of a dummy cylinder which incorporates a non-functional extractor and a ratchet integrally into its back end, with an integral firing pin cushioning mechanism that cannot be removed shown in exploded view.

In a most preferred embodiment, best shown in FIG. 3, the dummy cylinder 30 has a firing-pin-cushioning mechanism 46 integrally and permanently placed where the chamber 24 would normally be. In this embodiment, the external dimensions of the dummy cylinder 30 are intended to simulate the relevant external dimensions of firing cylinder 10 with cartridges 24 fully inserted into it. The relevant external dimensions in this case thus include not only those of firing cylinder 10, but also the exposed rim 45 of cartridge 24. In one embodiment, dummy rim 47 is integrally formed onto dummy cylinder 30. It is also possible to omit the dummy rim 47 provided that the plug 54 is designed to properly simulate rim 45. The firing-pin cushioning mechanism 46 comprises a spring 48, a plunger 50, a cavity 52, and a plug 54. FIG. 3 shows an exploded view of the mechanism 46. The spring 48 is placed in the cavity 52, and then plunger 50 is placed inside of it. Flange 58 causes plunger 50 to compress the spring when urged towards the front end 40. Plug 54 is placed over plunger 50 and inserted into cavity 52. The plug 54 is designed to lock into the cavity by some means. This may be elastic mechanical means, such as a clip or a raised ridge (not shown), or it may be a chemical means such as adhesive or solvent-welding. It could also screw in. These options are well known to makers of snap caps. Plug 54 has a hole 56 which permits the plunger to pass through, but which is too small for the flange 58. Thus, the plunger 52 is exposed where it may be struck by the firing pin, and move forward, compressing spring 48, thus simulating the presence of a primer.

One mechanism 46 is placed in the dummy cylinder 30 for each of the chambers of cylinder 10. Thus, when dummy cylinder 30 is placed on the revolver, it functions as though a snap cap had been inserted into each chamber 22.

Preferably, the dummy cylinder 30 is has a color that differentiates it from cylinder 10 immediately. A common "safety" color is blaze orange, such as is worn by hunters and highway workers. Such a bright color instantly tells anyone who can see the revolver that it does not contain a firing cylinder 10, and therefore cannot fire. Blue and red are also conventionally used for dummy guns and therefore may be appropriate as well. The dummy cylinder 30 may be constructed of a material that is entirely one color, or may be painted. It is not necessary for the dummy cylinder 30 to be a solid color; a stripe or other pattern may also be used.

The dummy cylinder 30 can be produced from any convenient material. Polymers such as plastic or hard rubber are preferred because they are inexpensive to mold to the correct shape and easy to color. Where durability is a concern, metals may be preferred. Plunger 50 is conventionally constructed of brass, which is soft enough not to damage firing pins but hard enough to withstand repeated impacts. Plug 54 is may be constructed of the same polymer as dummy cylinder 30 so as to be compatible with the same adhesives. It may also be of a different polymer, as may be advantageous when using a clip mechanism to provide sufficient resilience. It could also be formed of metal, such as brass, to increase durability or allow for greater dimensional precision. However, the choice of material for any of these parts is not critical.

I claim:

1. A dummy cylinder for a revolver, said revolver having a corresponding firing cylinder and caliber, said dummy cylinder having a front end and a back end, and a hole about an axis, said dummy cylinder substantially duplicating the external dimensions of the firing cylinder, and said hole capable of closely receiving a pivot tube of a crane, said dummy cylinder having at least one opening, said opening having internal dimensions that prevent the insertion of ammunition intended for the revolver's caliber into both the front end and the back end.

2. The dummy cylinder of claim 1 wherein said internal dimensions prevent the insertion of any ammunition at all.

3. The dummy cylinder of claim 2 wherein said external dimensions substantially duplicate the dimensions of the firing cylinder when the firing cylinder has ammunition fully inserted into it.

4. The dummy cylinder of claim 1 wherein said revolver has a ratchet and extractor, and the back end of the dummy cylinder is configured to duplicate the extractor and ratchet.

5. The dummy cylinder of claim 1 wherein said revolver has a ratchet and extractor, and wherein the back end of the dummy cylinder is configured to receive the extractor and ratchet and hold them in substantially the same position as they are in during normal firing.

6. The dummy cylinder of claim 1 wherein the opening contains a firing-pin-cushioning mechanism.

7. The dummy cylinder of claim 1 wherein the opening allows the insertion of a firing-pin-cushioning mechanism.

8. The dummy cylinder of claim 1 wherein the dummy cylinder has a color that readily distinguishes it from the firing cylinder.

9. The dummy cylinder of claim 8 wherein the color is orange.

10. The dummy cylinder of claim 1 wherein dummy cylinder is constructed of a polymer.

11. A revolver having a dummy cylinder installed upon it, said revolver having a corresponding firing cylinder and caliber, said revolver comprising an extractor and a ratchet, wherein said dummy cylinder comprises a front end, a back end, and a hole about an axis, said dummy cylinder substantially duplicating the external dimensions of the firing cylinder, and said hole capable of closely receiving a pivot tube of a crane, said dummy cylinder having at least one opening, said opening having internal dimensions that prevent the insertion of ammunition intended for the revolver's caliber into both the front end and the back end.

12. The revolver of claim 11 wherein said internal dimensions prevent the insertion of any ammunition at all.

13. The revolver of claim 12 wherein said external dimensions of said dummy cylinder substantially duplicate the dimensions of the firing cylinder when the firing cylinder has ammunition fully inserted into it.

14. The revolver of claim 11 wherein the back end of said dummy cylinder is configured to duplicate the extractor and ratchet.

15. The revolver of claim 11 wherein the back end of said dummy cylinder is configured to receive the extractor and ratchet and hold them in substantially the same position as they are held in during normal firing.

16. The revolver of claim 11 wherein the opening contains a firing-pin-cushioning mechanism.

17. The revolver of claim 11 wherein the opening permits the insertion of a firing-pin-cushioning mechanism.

18. The revolver of claim 11 wherein the dummy cylinder has a color that readily distinguishes it from the firing cylinder.

19. The revolver of claim 18 wherein the color is orange.

20. The revolver of claim 11 wherein the dummy cylinder is constructed of a polymer.

* * * * *